US010203119B2

(12) United States Patent
Weiss et al.

(10) Patent No.: US 10,203,119 B2
(45) Date of Patent: Feb. 12, 2019

(54) LOW PROFILE DAMPER SYSTEM FOR OVENS

(71) Applicant: FIELD CONTROLS, L.L.C., Kinston, NC (US)

(72) Inventors: Cory A. Weiss, Warren, MI (US); Steven E. Guzorek, Kinston, NC (US)

(73) Assignee: FIELD CONTROLS, LLC, Kinston, NC (US)

( * ) Notice: Subject to any disclaimer, the term of this patent is extended or adjusted under 35 U.S.C. 154(b) by 289 days.

(21) Appl. No.: 14/885,343

(22) Filed: Oct. 16, 2015

(65) Prior Publication Data

US 2016/0109137 A1 Apr. 21, 2016

Related U.S. Application Data

(60) Provisional application No. 62/066,668, filed on Oct. 21, 2014.

(51) Int. Cl.

| | |
|---|---|
| ***F24C 15/00*** | (2006.01) |
| ***F24C 15/20*** | (2006.01) |
| ***F24C 3/12*** | (2006.01) |
| ***F23L 11/00*** | (2006.01) |
| ***F24C 3/00*** | (2006.01) |

(52) U.S. Cl.

CPC ..... *F24C 15/2021* (2013.01); *F23L 11/00* (2013.01); *F23L 11/005* (2013.01); *F24C 3/008* (2013.01); *F24C 3/128* (2013.01); *F24C 15/002* (2013.01)

(58) Field of Classification Search

CPC ..... F23L 11/00; F23L 11/005; F24F 13/12; F16K 11/06; F16K 11/07

See application file for complete search history.

(56) References Cited

U.S. PATENT DOCUMENTS

| | | | | | |
|---|---|---|---|---|---|
| 2,936,692 | A * | 5/1960 | White | F24F 7/00 | 454/260 |
| 4,210,200 | A * | 7/1980 | Vary | F24H 3/0411 | 165/54 |
| 4,676,145 | A * | 6/1987 | Allred | E04B 1/7076 | 454/276 |
| 4,879,878 | A * | 11/1989 | Polkinghorne | F25D 17/065 | 251/129.1 |
| 4,955,286 | A * | 9/1990 | Muller | F24F 13/06 | 454/297 |
| 4,964,566 | A * | 10/1990 | Pugh | E02D 31/008 | 137/625.33 |

(Continued)

OTHER PUBLICATIONS

Examination Report for Canadian Patent Application 2,908,985 dated Jul. 12, 2017, 3 pgs.

(Continued)

*Primary Examiner* — Kenneth Rinehart
*Assistant Examiner* — Deepak Deean
(74) *Attorney, Agent, or Firm* — Brinks Gilson & Lione

(57) ABSTRACT

A damper system comprises a damper slide adapted to couple to a wall with a first outlet. In one embodiment, the damper slide has a first opening and is adapted to operate in a first position and a second position. In the first position, the first opening is at least partially aligned with the first outlet. The first opening and the first outlet are at least partially offset in the second position.

17 Claims, 6 Drawing Sheets

(56) References Cited

U.S. PATENT DOCUMENTS 5,120,273 A * 6/1992 Lin ..... E06B 7/02 454/195
5,207,614 A * 5/1993 Passadore ..... F24F 13/12 137/625.3
5,215,454 A * 6/1993 Ferramola ..... F23C 7/00 431/114
5,218,998 A * 6/1993 Bakken ..... F24F 13/12 137/625.28
5,739,446 A * 4/1998 Bahnson ..... G10D 7/123 84/377
5,816,061 A * 10/1998 Lee ..... F24F 13/06 62/187
5,881,806 A 3/1999 Rudd
D409,073 S 5/1999 Bluestone
6,035,849 A 3/2000 Bluestone
6,073,458 A * 6/2000 Kim ..... F24F 13/12 454/195
6,082,704 A 7/2000 Grinbergs
6,409,143 B1 6/2002 Beck et al.
6,431,268 B1 8/2002 Rudd
6,557,501 B2 5/2003 Hughes
6,644,957 B2 11/2003 Weiss
6,745,724 B2 6/2004 Hughes et al.
6,749,124 B2 6/2004 Weiss
6,749,125 B1 6/2004 Carson et al.
6,915,799 B2 7/2005 Weiss
7,195,556 B1 * 3/2007 Fichtelman ..... E04D 13/152 454/260
7,232,369 B2 * 6/2007 Karidis ..... F24F 7/10 454/274
7,258,280 B2 8/2007 Wolfson
7,451,759 B2 11/2008 Weiss et al.
7,687,748 B2 * 3/2010 Gagas ..... H05B 6/1263 126/21 A
7,721,972 B2 5/2010 Bracken et al.
8,113,823 B2 2/2012 Guzorek
8,142,265 B2 * 3/2012 Carter ..... F24F 13/12 454/289
8,297,524 B2 10/2012 Kucera et al.
2006/0278216 A1 12/2006 Gagas et al.
2013/0048743 A1 2/2013 Kucera et al.

OTHER PUBLICATIONS

Examiner's Report for Canadian Patent Application No. 2,908,985 dated Oct. 11, 2016, 4 pgs.
Response to Examination Report for Canadian Patent Application 2,908,985 dated Jan. 11, 2018, 5 pgs.
Notice of Allowance for Canadian Patent Application 2,908,985 dated Apr. 12, 2018, 1 pg.

* cited by examiner

LOW PROFILE DAMPER SYSTEM FOR OVENS

PRIORITY CLAIM

This invention claims the benefit of priority of U.S. Provisional Application Ser. No. 62/066,668, entitled "Low Profile Damper System for Ovens," filed Oct. 21, 2014, the disclosure of which is hereby incorporated by reference in its entirety.

BACKGROUND

The present embodiments relate generally to a damper system adapted to operate with an oven, for example, a residential or commercial cooking oven.

Conventional ovens vent products of combustion and cooking near the back of the oven chamber wall and at the top of the oven after traveling from the burner through the oven chamber and then to an output. The purpose of the output is to expel the products of combustion and secondarily to output the gases created by baking, cooking, and broiling. The oven temperatures are generally modulated by an off/on burner cycle. During the burner "on" cycle, air flows from the open bottom of the oven, through the oven cavity along with the combustion products, to the top of the oven. The hot air being lighter, it then egresses through the output at the top of the chamber. This output is sized to allow enough air flow to sustain an efficient combustion. During the burner "off" cycle, air continues to flow due to the diminished density of the hot air rising and exiting through the output. This continuous flow during the burner "off" cycle may produce substantial heat loss and wasted energy. Broiling works in a similar fashion with comparable air flow.

The provision of an output at the bottom of the chamber can save energy. In other situations, such as "clean up" operations, it remains desirable to provide an output at the top of the chamber. Selectively achieving various output positions is therefore desirable. However, existing damper systems capable of achieving various output positions for the egress of hot gases may add significantly to the back-to-front profile of ovens, which may be undesirable in residential settings and in commercial settings where space is at a premium.

SUMMARY

A damper, system comprises a damper slide adapted to couple to a wall with a first outlet. In one embodiment, the damper slide has a first opening and is adapted to operate in a first position and a second position. In the first position, the first opening is at least partially aligned with the first outlet. The first opening and the first outlet are at least partially offset in the second position.

The damper system may have a vent riser coupled to the wall, where the vent riser and the wall form a chimney. When the damper system is in the first position, the chimney may be in fluid communication with a chamber of the oven. In one embodiment, the damper slide is at least partially contained within the chimney.

In another embodiment, the damper slide may have a second opening, and may be adapted to operate in a second position, where the second opening and a second outlet on the wall are at least partially aligned. Further, the damper slide may be adapted to operate in a third position where the chamber and the chimney are not in fluid communication.

Other systems, methods, features, and advantages of the invention will be, or will become, apparent to one with skill in the art upon examination of the following figures and detailed description. It is intended that all such additional systems, methods, features, and advantages be within the scope of the invention, and be encompassed by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
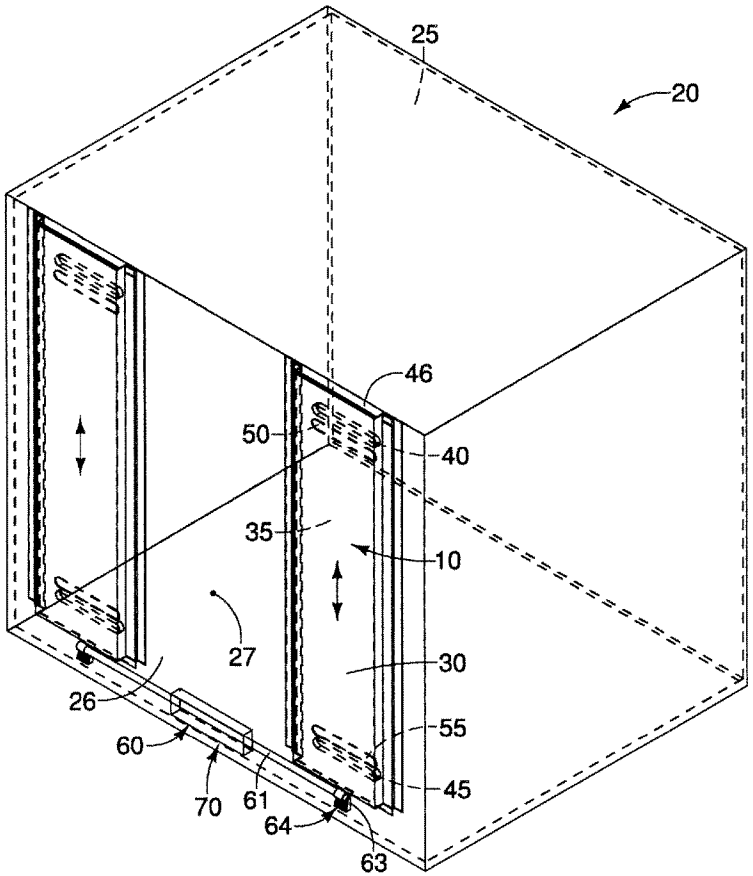
FIG. 1 is a perspective view of a first embodiment of an exemplary damper system that may be used in conjunction with an oven.

Referring to FIG. 1, an exemplary oven 20 comprises chamber 25, wall 26 with first outlet 40 and second outlet 45, and damper system 10. By way of example and without limitation, oven 20 may be a residential or commercial cooking oven. In a first embodiment, damper system 10 comprises vent riser 30 and damper slide 35.

Figure 2:
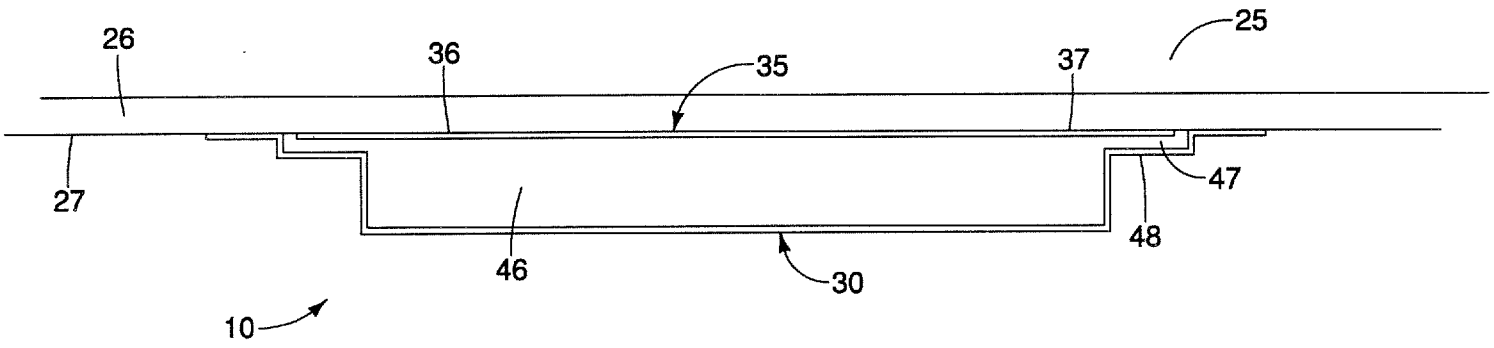
FIG. 2 is a top view of a vent riser and damper slide coupled to a wall of an oven.

Referring to FIGS. 1-2, vent riser 30 is shaped to form chimney 46 when coupled to wall 26, Chimney 46 is preferably open to an outside environment. Damper slide 35 is contained at least partially within vent riser 30. Inner damper surface 36 faces chamber 25. As best seen in FIG. 2, damper slide 35 is positioned opposite of chamber 25 with respect to wall 26. As shown in FIG. 1, damper slide 35 includes at least first and second openings 50, 55. Chamber 25 and chimney 46 may be in fluid communication when openings 50, 55 are respectively aligned with outlets 40, 45. For example, when first opening 50 is aligned with first outlet 40, chamber 25 and chimney 46 may be in fluid communication through channel 80 (see FIG. 3C). Similarly, when second opening 55 is aligned with second outlet 45, chamber 25 and chimney 46 may be in fluid communication through channel 85 (see FIG. 3B).

Referring to FIG. 2, vent riser 30 is coupled to wall 26 opposite chamber 25. In one embodiment, damper slide 35 comprises a flat plate positioned parallel to wall 26 and adjacent to wall surface 27. Further, vent riser 30 may be shaped to form one or more outer cavities 47 within the chimney 46. As depicted by FIG. 2, wall 26 and vent riser 30 form cavity 47 for receiving an outer edge 37 of damper slide 35. Cavity wall 48 may contact damper slide 35 to maintain proper spacing, ensuring that damper slide 35 is positioned close enough to wall 48 such that it is capable of substantially blocking outlets 40, 45. Alternatively, or in addition, damper slide 35 may attach to wall 26 through the use of a track or any other attachment mechanism known in the art that allows for position adjustment. The current structure of damper system 10 is advantageous because the total extension backward from wall 26 is substantially smaller than previously-known damper systems, which saves space at the back portion of oven 20. This is desirable in environments with limited space and where it is desired to have an oven 20 with a small back-to-front profile without sacrificing the size of chamber 25.

Figure 3C:
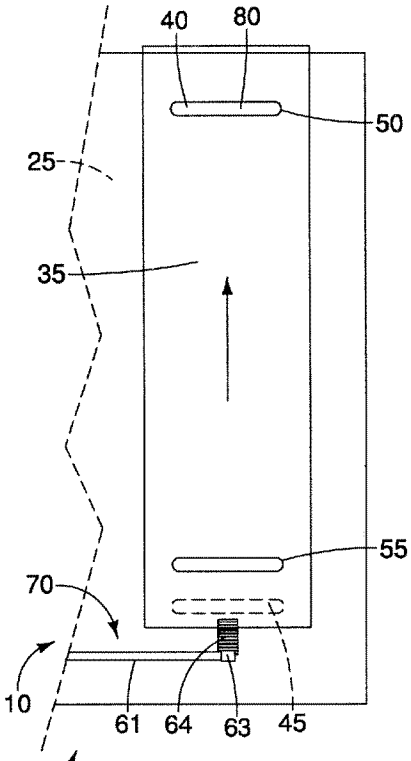
FIGS. 3A-C are, respectively, front views of portions of the damper system of FIG. 1 with a damper slide positioned in a third, second, and first position.
Figure 3B:
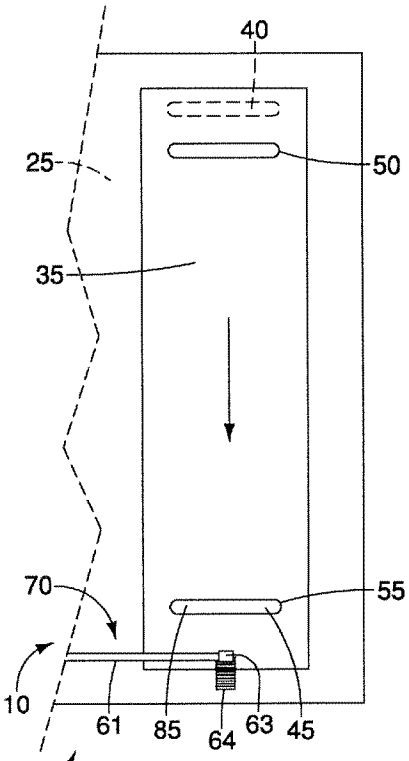
Figure 3A:
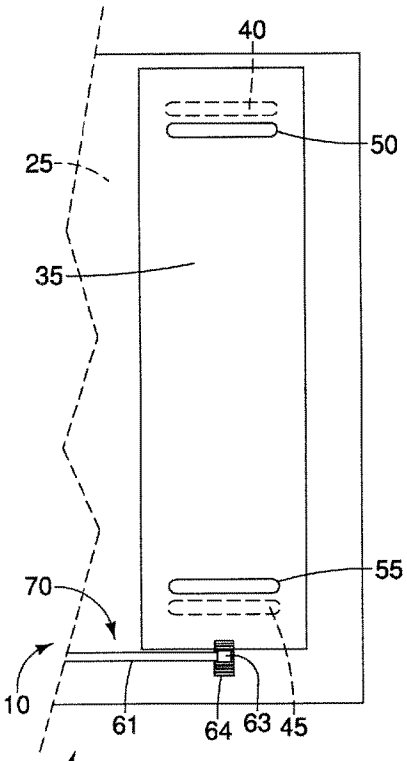

In one embodiment, as depicted in FIGS. 3A-C, first opening 50 and second opening 55 are positioned on damper slide 35 such that only one of openings 50, 55 may be respectively aligned with outlets 40, 45, thereby providing only one channel 80, 85 from chamber 25 to chimney 46. Other embodiments may allow for multiple channels simultaneously. In the embodiment of FIGS. 1-3, when one of openings 50, 55 is respectively aligned with outlets 40, 45, damper slide 35 substantially blocks the nonaligned outlet 40, 45.

Damper slide 35 may additionally be positioned such that all outlets are blocked. For example, as shown in FIG. 3A, oven 20 may operate in an off-mode with its heat source off and where it may be desired that the heated gases in chamber 25 are contained. In the described off-mode, damper system 10 provides a damper slide 35 positioned such that openings 50, 55 are substantially or entirely misaligned with outlets 40, 45. Damper slide 35 covers first outlet 40 and second outlet 45, thereby blocking the flow of gases from chamber 25 to chimney 46.

Alternatively, as best shown in FIG. 3B, oven 20 may operate in a first on-mode, where generally it is desired to provide an outlet for heated gases at substantially the bottom of chamber 25. In this mode, damper slide 35 is positioned such that second outlet 45 and second opening 55 are substantially aligned, providing channel 85 for the fluid communication of chamber 25 and chimney 46. Gases therefore may escape from chamber 25 into chimney 46 through channel 85. In this configuration, first opening 50 is positioned on damper slide 35 such that it is at least partially offset from first outlet 40. First outlet 40 is therefore partially or entirely blocked by damper slide 35 which prevents or restricts the flow of gases through vent 40.

As best shown by FIG. 3C, oven 20 may also operate in a second on-mode, where it is desired that heated gases flow out of chamber 25 through an output located at substantially the top of chamber 25. In this mode, damper slide 35 is positioned such that first outlet 40 and first opening 50 are substantially aligned, providing channel 80 for the fluid communication of chamber 25 and chimney 46. Gases may escape from chamber 25 into chimney 46 through channel 80. In this configuration, second opening 55 is positioned on damper slide 35 such that it is at least partially offset from second outlet 45. Second outlet 45 is therefore at least partially or entirely blocked by damper slide 35 which prevents or restricts the flow of gases through vent 45.

In another embodiment, damper slide 35 may have a plurality of openings allowing for a variety of desired cooking environments. For example, damper slide 35 may additionally comprise a plurality of openings, and respectively, wall 26 may comprise a plurality of corresponding outlets. In some embodiments, more than one outlet may align with an opening in damper slide 35 at once, allowing the flow of gases through multiple outputs from chamber 25 to chimney 46.

Further, in an alternative embodiment, damper slide 35 need not include any openings. In such an embodiment, wall 26 may comprise a plurality of outlets. Damper slide 35 may be shaped and sized such that it can be selectively positioned to cover at least one outlet while leaving at least one other outlet uncovered for selectively proving fluid communication from chamber 25 to chimney 46.

The positioning of damper slide 35 may be accomplished through a suitable actuation system. For example, in FIGS. 1 and 3A-C, oven 20 comprises actuation system 70 with actuator 60, which is capable of rotating horizontal shaft 61. Gear 63 is attached to horizontal shaft 61. Rack 64, coupled to gear 63, extends vertically downward from damper slide 35. In this embodiment, actuator 60 is capable of sliding damper slide 35 vertically upward or vertically downward into a desired position through rotation of horizontal shaft 61. This embodiment is advantageous because the actuator 60 is attached to wall 26 at a position vertically close to the bottom of chamber 25, reducing its exposure to heat. Further, as depicted by FIGS. 1 and 3A-3C, this embodiment is advantageous as it may allow the adjustment of a plurality of damper slides 35 with the use of only one actuator 60, as multiple gears 63 may be coupled to one or more horizontal shafts 61 extending from the actuator 60, allowing actuator 60 to control a plurality of damper systems 10 at once.

Figure 4:
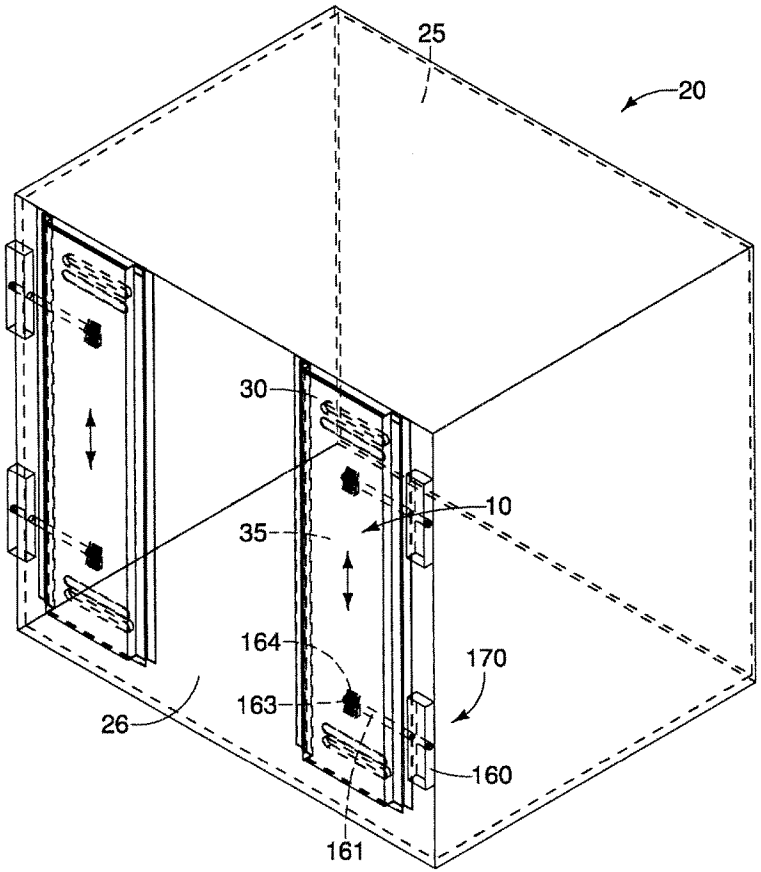
FIGS. 4-5 are perspective views of alternative embodiments of damper systems that may be used in conjunction with an oven.
Figure 5:
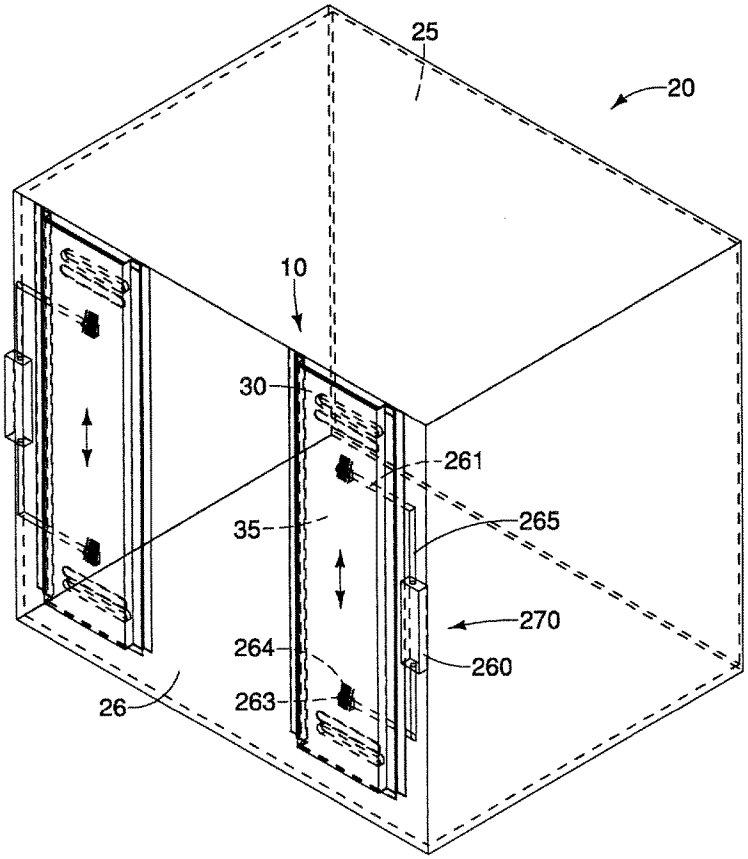

In another embodiment, shown in FIG. 4, damper system 10 comprises actuation system 170 with actuator 160 for rotating horizontal shaft 161. A gear 163 is fixed to horizontal shaft 161 and is coupled to damper slide 35 through teeth 164. Teeth 164 are formed on or attached to damper slide 35. Actuator 160 is therefore capable of positioning damper slide 35 through rotating shaft 161 and thereby rotating gear 163. In a similar embodiment, shown in FIG. 5, actuation system 270 comprises actuator 260, vertical shaft 265, horizontal shaft 261, gear 263, and teeth 264 formed on or attached to damper slide 35. Actuator 270 is capable of positioning damper slide 35 at a desired position through rotation of vertical shaft 265. Vertical shaft 265 is coupled to horizontal shaft 261 such that rotation along a vertical axis of vertical shaft 265 translates to rotation of the horizontal shaft 261 along a substantially horizontal axis, for example using connected bevel gears. Horizontal shaft 261 rotates gear 263, vertically moving damper slide 35. As in the embodiment depicted by FIG. 5, actuator 260 may rotate multiple vertical shafts 261, which in some embodiments may allow a single actuator 260 to move multiple damper slides 35.

Figure 6:
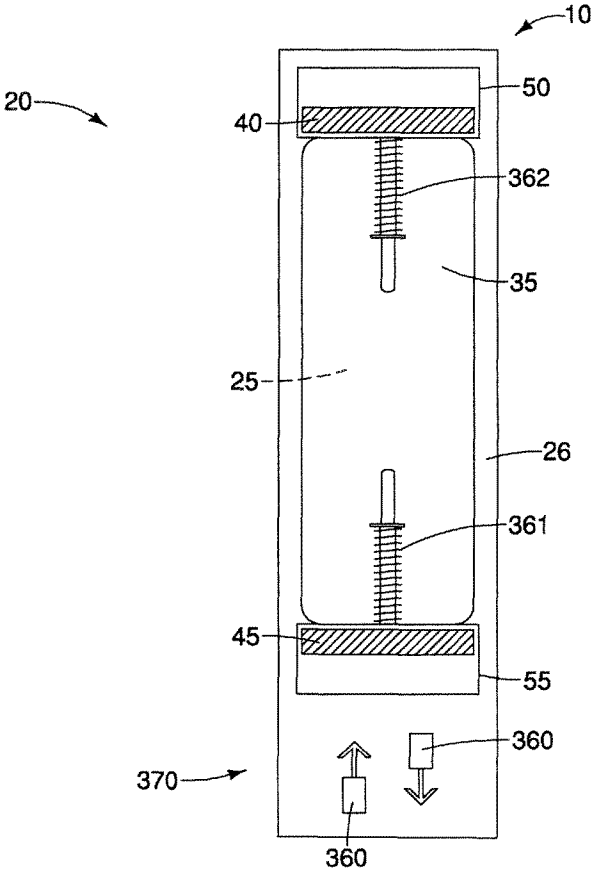
FIG. 6 is a front view of a further alternative embodiment of a damper system that may be used in conjunction with an oven.

FIG. 6 shows an alternative embodiment comprising actuation system 370 with solenoid actuator 360, 360', first spring 361, and second spring 362. In this embodiment, springs 361 and 362 provide a predetermined directional force on damper slide 35. Actuation system 370 may have any number of springs tending to force damper slide 35 in any direction. In the embodiment shown, when solenoid actuator 360, which is coupled to damper slide 35, is actuated, solenoid actuator overcomes the force of springs 361, 362 and positions damper slide 35 in an actuated position. When solenoid actuator 360' is not actuated, springs 361 and 362 force damper slide 35 into an unactuated position. Actuation system 370 may additionally be capable of positioning damper slide 35 at a plurality of positions through intermediate levels of actuation. Each desired position of damper slide 35 selectively covers or uncovers outlets of wall 26 for providing a desired atmosphere in chamber 25.

While various embodiments of the invention have been described, the invention is not to be restricted except in light of the attached claims and their equivalents. Moreover, the advantages described herein are not necessarily the only advantages of the invention and it is not necessarily expected that every embodiment of the invention will achieve all of the advantages described.

We claim:

1. An appliance, comprising:

a chamber, and a wall having a first outlet and a second outlet;

a damper slide adapted to couple to the wall, the damper slide having multiple openings, wherein the damper slide is further adapted to operate in a first position and a second position, wherein a first opening is at least partially aligned with the first outlet in the first position, wherein the first opening and the first outlet are at least partially offset in the second position, wherein moving the damper slide in a first direction advances the first opening further to a fully open state while simultaneously moving a second opening further to a fully closed state, and wherein the damper slide lacks a mode in which two or more openings are simultaneously aligned in an open state.

2. The appliance of claim 1, further comprising a vent riser coupled to the wall, wherein the vent riser and the wall form a chimney.

3. The appliance of claim 2, wherein the chimney is in fluid communication with the chamber when the damper slide is in the first position.

4. The appliance of claim 1, wherein the damper slide lacks a mode in which all of the multiple openings are simultaneously aligned in an open state.

5. The appliance of claim 1, wherein the second opening and the second outlet of the wall are at least partially aligned when the damper slide is in the second position.

6. The appliance of claim 2, wherein the damper slide is further adapted to operate in a third position, and wherein the chamber and the chimney are not in fluid communication when the damper slide is in the third position.

7. The appliance of claim 2, wherein the damper slide is at least partially contained within the chimney.

8. An appliance, comprising:

a chamber, and a wall having a first outlet and a second outlet, wherein a first solid region of the wall is disposed inward of the first outlet, and a second solid region of the wall is disposed inward of the second outlet;

a damper slide with a first opening and a second opening; and an actuator for moving the damper slide to a first position or a second position, wherein the damper slide is configured to be positioned adjacent to the wall, wherein the first opening and the first outlet form a first channel when the damper slide is in the first position, wherein the second opening and the second outlet form a second channel when the damper slide is in the second position, and wherein the first opening in its closed state remains within the first solid region, and wherein the second opening in its closed state remains within the second solid region.

9. The appliance of claim 8, wherein, in a closed state, the first and second openings in the damper slide are both positioned in-between the first and second outlets in the wall.

10. The appliance of claim 9, wherein the damper slide blocks the second outlet when the damper slide is in the first position, and wherein the damper slide blocks the first outlet when the damper slide is in the second position.

11. The appliance of claim 10, wherein the first opening and the first outlet are substantially offset when the damper slide is in the second position, and wherein the second opening and the second outlet are substantially offset when the damper slide is in the second position.

12. The appliance of claim 8, further comprising a vent riser, wherein the vent riser and the wall form a chimney, and wherein the damper slide is at least partially contained within the chimney, wherein the chimney is in fluid communication with the chamber through the first channel when the damper slide is in the first position, and wherein the chimney is in fluid communication with the chamber through the second channel when the damper slide is in the second position.

13. The appliance of claim 12, wherein the actuator is adapted to move the damper slide to a third position.

14. The appliance of claim 13, wherein the chimney is not in fluid communication with the chamber when the damper slide is in the third position.

15. The appliance of claim 12, wherein the chimney has a cavity for receiving an outer edge of the damper slide.

16. An appliance, comprising:

chamber and a wall having a first outlet and a second outlet, wherein a first solid region of the wall is disposed inward of the first outlet, and a second solid region of the wall is disposed inward of the second outlet;

a damper slide with a first opening and a second opening; and an actuator for moving the damper slide to a first position or a second position, wherein the damper slide is configured to be positioned adjacent to the wall, wherein the first opening and the first outlet form a first channel in a first on-mode when the damper slide is in the first position, wherein the second opening and the second outlet form a second channel in a second on-mode when the damper slide is in the second position, and wherein in the first on-mode the first channel is aligned only at the bottom of the chamber, and in the second on-mode the second channel is aligned only at the top of the chamber, wherein the first opening in its closed state remains within the first solid region, and wherein the second opening in its closed state remains within the second solid region.

17. The appliance of claim 16, further comprising a vent riser, wherein the vent riser and the wall form a chimney, and wherein the damper slide is at least partially contained within the chimney.

* * * * *